US007459869B2

(12) United States Patent
Park

(10) Patent No.: US 7,459,869 B2
(45) Date of Patent: Dec. 2, 2008

(54) DRIVING APPARATUS OF MOTOR

(75) Inventor: Kyeong-Bae Park, Seoul (KR)

(73) Assignee: LG Electronics Inc., Seoul (KR)

( * ) Notice: Subject to any disclaimer, the term of this patent is extended or adjusted under 35 U.S.C. 154(b) by 234 days.

(21) Appl. No.: 10/414,231

(22) Filed: Apr. 16, 2003

(65) Prior Publication Data

US 2004/0080287 A1 Apr. 29, 2004

(30) Foreign Application Priority Data

Oct. 25, 2002 (KR) ..... 10-2002-0065564

(51) Int. Cl.
*H02K 33/12* (2006.01)
*H02P 1/00* (2006.01)

(52) U.S. Cl. ..... 318/124; 318/123; 417/12

(58) Field of Classification Search ..... 417/44.1, 417/12, 32, 44.11, 415; 363/106, 37, 34, 363/25; 318/123, 124
See application file for complete search history.

(56) References Cited

U.S. PATENT DOCUMENTS

| | | | | |
|---|---|---|---|---|
| 3,095,531 A | | 6/1963 | Leland | |
| 3,913,342 A | * | 10/1975 | Barry | 62/115 |
| 4,991,049 A | * | 2/1991 | Kadah | 361/28 |
| 5,960,898 A | * | 10/1999 | Okada et al. | 180/65.8 |
| 6,006,996 A | * | 12/1999 | Bhatnagar | 236/78 R |
| 6,318,966 B1 | * | 11/2001 | Madara et al. | 417/12 |
| 6,384,558 B2 | * | 5/2002 | Yoshida et al. | 318/445 |

FOREIGN PATENT DOCUMENTS

| | | |
|---|---|---|
| DE | 2820950 | 11/1979 |
| DE | 1 9529763 | 2/1997 |
| JP | 8-251985 | 9/1996 |
| JP | 2001-320897 | 11/2001 |
| JP | 2002-081383 | 3/2002 |
| JP | 2002-511729 | 4/2002 |

OTHER PUBLICATIONS

English language Abstract of JP 2001-320897.
English language Abstract of JP 2002-511729.
English language Abstract of JP 8-251985.
English language Abstract of JP 2002-081383.

* cited by examiner

*Primary Examiner*—Devon Kramer
*Assistant Examiner*—Patrick Hamo
(74) *Attorney, Agent, or Firm*—Greenblum & Bernstein, P.L.C.

(57) ABSTRACT

A driving apparatus of a motor capable of operating a motor of a reciprocating compressor stably by using a simple power voltage control unit. The apparatus includes a power voltage control unit for maintaining a power voltage supplied from a power supply unit as a certain value when a motor is operated, outputting the certain power voltage or cutting off the power voltage after a certain time has passed; and a capacitor for applying the power voltage supplied from the power supply unit to the motor when the power voltage control unit cuts off the power voltage.

9 Claims, 4 Drawing Sheets

DRIVING APPARATUS OF MOTOR

CROSS-REFERENCE TO RELATED APPLICATION

The present application claims priority under 35 U.S.C. § 119 of Korean Patent Application No. 2002-65564, filed on Oct. 25, 2002, the disclosure of which is expressly incorporated by reference herein in its entirety.

BACKGROUND OF THE INVENTION

1. Field of the Invention

The present invention relates to a reciprocating compressor, and in particular to a driving apparatus of a motor which is capable of driving a motor of a reciprocating compressor stably and efficiently without using a microcomputer.

2. Description of the Prior Art

In general, a compressor is for compressing a refrigerant circulating a cooling apparatus such as an air conditioner and a refrigerator so as to be in a high temperature-high pressure state.

Compressors can be divided into several types. For example, there is a reciprocating compressor, a rotary type compressor, a BLDC (brushless direct current) type compressor, an inverter type compressor and a variable reciprocating compressor having a variable rotational speed. Herein, because the reciprocating compressor can vary a piston stroke according to a rotational force of a motor, it is possible to control cooling capacity according to a user's intention. A driving apparatus for driving the reciprocating compressor will be described with reference to accompanying FIG. 1.

FIG. 1 illustrates a driving apparatus of a reciprocating compressor in accordance with the conventional art.

FIG. 2 is a wave diagram illustrating a piston stroke of the reciprocating compressor in FIG. 1.

As depicted in FIG. 1, the driving apparatus of the reciprocating compressor in accordance with the conventional art includes a capacitor C for applying a power voltage (for example, AC) to a motor 10. Herein, the capacitor C performs a function for maintaining varying piston stroke uniformly as a set piston stroke when an operational load of the reciprocating compressor is varied.

In the conventional driving apparatus of the reciprocating compressor, when a power voltage is supplied to the motor 10 through the capacitor C, impedance in the motor 10 is reduced as same as capacitive reactance of the capacitor C due to electric resonance characteristics. In addition, a counter electromotive force does not exist in the motor 10 in the initial operation state of the reciprocating compressor.

Accordingly, as depicted in FIG. 2, because the impedance is reduced in the counter electromotive force non-existence state, the power voltage supplied to the motor 10 is increased, an excessive stroke in which a piston (not shown) may collide against other construction parts installed at the top or bottom portion of a cylinder of the reciprocating compressor may occur.

In the meantime, in the initial operation state of the reciprocating compressor, when the power voltage is supplied to the motor 10 through the capacitor C, in order to prevent an excessive piston stroke, the power voltage supplied to the motor 10 is controlled by using a microcomputer. It will be described with reference to accompanying FIG. 3.

FIG. 3 illustrates another example of a driving apparatus of a reciprocating compressor in accordance with the conventional art.

FIG. 4 is a wave diagram illustrating a piston stroke of the reciprocating compressor in FIG. 3.

As depicted in FIG. 3, the driving apparatus of the reciprocating compressor in accordance with the conventional art includes a microcomputer 11 for adjusting a power voltage as a certain voltage value and outputting the adjusted voltage in the initial operation of the reciprocating compressor; a capacitor C for applying the power voltage adjusted by the microcomputer 11 to a motor 10; and the motor 10 for varying a piston stroke of the compressor by being operated according to the power voltage applied through the capacitor C.

First, the microcomputer 11 adjusts the power voltage for operating the reciprocating compressor as a voltage value such that an excessive stroke is avoided, and outputs the adjusted voltage to the motor 10. In more detail, as depicted in FIG. 4, the motor 10 maintains a stable piston stroke in the operation by the power voltage applied through the capacitor C.

However, when the reciprocating compressor is operated, because the power voltage supplied to the motor is controlled by the microcomputer, production cost of the reciprocating compressor may be increased due to the presence of the microcomputer.

SUMMARY OF THE INVENTION

The present invention provides a driving apparatus of a motor which is capable of operating a motor of a reciprocating compressor stably by using a power voltage control unit having a simple structure.

A driving apparatus of a motor in accordance with the present invention includes a power voltage control unit for maintaining a power voltage supplied from a power supply unit as a certain value when a motor is operated, outputting the certain power voltage or cutting off the power voltage after a certain time has passed; and a capacitor for applying the power voltage supplied from the power supply unit to the motor when the power voltage control unit cuts off the power voltage.

In a certain aspect of the invention, the motor may a reciprocating compressor motor, and/or the power voltage control unit may be a positive temperature coefficient (PTC) device.

In another aspect of the invention, the PTC device may be configured to apply the power voltage to the motor in an initial state and cut off the power voltage after the certain time has passed.

In a further aspect of the invention, the power voltage control unit may include a timer configured to generate a control signal after the certain time has passed and output the control signal, a relay configured to select between outputting the initial power voltage supplied from the power supply unit and cutting off the power voltage based on the control signal, and a resistor configured to apply the power voltage outputted from the relay to the motor.

In still another aspect of the invention, the timer may be configured to count a time when the power voltage is supplied to the motor in the initial state and output the control signal when the time reaches the certain time.

A driving apparatus of a reciprocating compressor in accordance with the present invention includes a PTC (positive temperature coefficient) device for maintaining a power voltage supplied from a power supply unit as a certain value when a motor is operated, outputting the certain power voltage or cutting off the power voltage after a certain time has passed; and a capacitor for applying the power voltage supplied from the power supply unit to the motor when the PTC device cuts off the power voltage.

The PTC device may be configured to apply the power voltage to the motor in an initial state and cut off the power voltage after the certain time has passed.

A driving apparatus of a reciprocating compressor in accordance with the present invention includes a timer for applying a power voltage supplied from a power supply unit in an initial operation of a motor of a reciprocating compressor, generating a control signal when a certain time has passed and outputting the generated control signal; a relay for outputting the power voltage applied from the timer or cutting off the control signal on the basis of the control signal; a resistor for maintaining the power voltage outputted from the relay as a certain value and applying the certain power voltage to the motor; and a capacitor for applying the power voltage supplied from the power supply unit to the motor when the relay cuts off the power voltage.

The timer may be configured to count a time when the power voltage is supplied to the motor in the initial state and output the control signal when the time reaches the certain time.

The method of the present invention includes supplying a power voltage to a power voltage control unit, maintaining the power voltage at a predetermined level, using the power voltage control unit, when the motor is operated, selectively outputting the predetermined power voltage and cutting off the power voltage after a predetermined time has passed, and applying the power voltage to the motor, using a capacitor, when the power voltage is cut off by the power voltage control unit.

In an aspect of the invention, the motor may be a reciprocating compressor motor, and the power voltage control unit may be a positive temperature coefficient (PTC) device.

In another aspect of the invention, the applying may further include applying, using the PTC, the power voltage to the motor in an initial state and cutting off, using the PTC, the power voltage after the predetermined time has passed.

In a further aspect of the invention, the method may include generating a control signal after the predetermined time has passed, outputting the control signal, selectively outputting the initial power voltage supplied from the power supply unit and cutting off the power voltage, based on the control signal, and applying the power voltage outputted from the relay to the motor.

In an additional aspect of the invention, the method may include counting a time when the power voltage is supplied to the motor in the initial state, and outputting the control signal when the time reaches the predetermined time.

Another method according to the present invention includes supplying a power voltage to a power voltage control unit, maintaining the power voltage at a predetermined level, using a positive temperature coefficient (PTC) device, when a motor is operated, selectively outputting the predetermined power voltage and cutting off the power voltage after a predetermined time has passed, and applying the power voltage to the motor, using a capacitor, when the power voltage is cut off by the PTC device.

The applying of the method may also include applying, using the PTC, the power voltage to the motor in an initial state and cutting off, using the PTC, the power voltage after the predetermined time has passed.

A further method includes applying a power voltage supplied from a power supply unit in an initial operation of a motor of a reciprocating compressor, generating a control signal when a predetermined time has passed, outputting the generated control signal, selectively outputting the applied power voltage and cutting off the control signal, based on the control signal, maintaining the outputted power voltage as a predetermined value and applying the predetermined power voltage to the motor, and applying the power voltage supplied from the power supply unit to the motor when the power voltage is cut off.

The method may also include counting a time when the power voltage is supplied to the motor in the initial state and outputting the control signal when the time reaches the predetermined time. Also, the applying the power voltage may include using a capacitor.

Other exemplary embodiments and advantages of the present invention may be ascertained by reviewing the present disclosure and the accompanying drawings.

BRIEF DESCRIPTION OF THE DRAWINGS

The power supply unit shown in the accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, the preferred embodiments of a driving apparatus of a motor for a reciprocating compressor capable of controlling the motor stably by supplying a power voltage to the motor through, not a capacitor, but through a PTC or a relay and a resistor in an initial operation of the reciprocating compressor, and supplying a power voltage to the motor only through the capacitor after a certain time has passed, will be described with reference to accompanying FIGS. 5~8. In addition, in the embodiments of the present invention, a motor used for the reciprocating compressor is described, however, it is possible to use a driving apparatus of a motor in accordance with the present invention for any apparatus requiring a stable motor.

Figure 1:
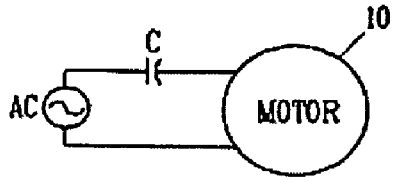
FIG. 1 CONVENTIONAL ART
FIG. 1 illustrates a driving apparatus of a reciprocating compressor in accordance with the conventional art.
Figure 2:
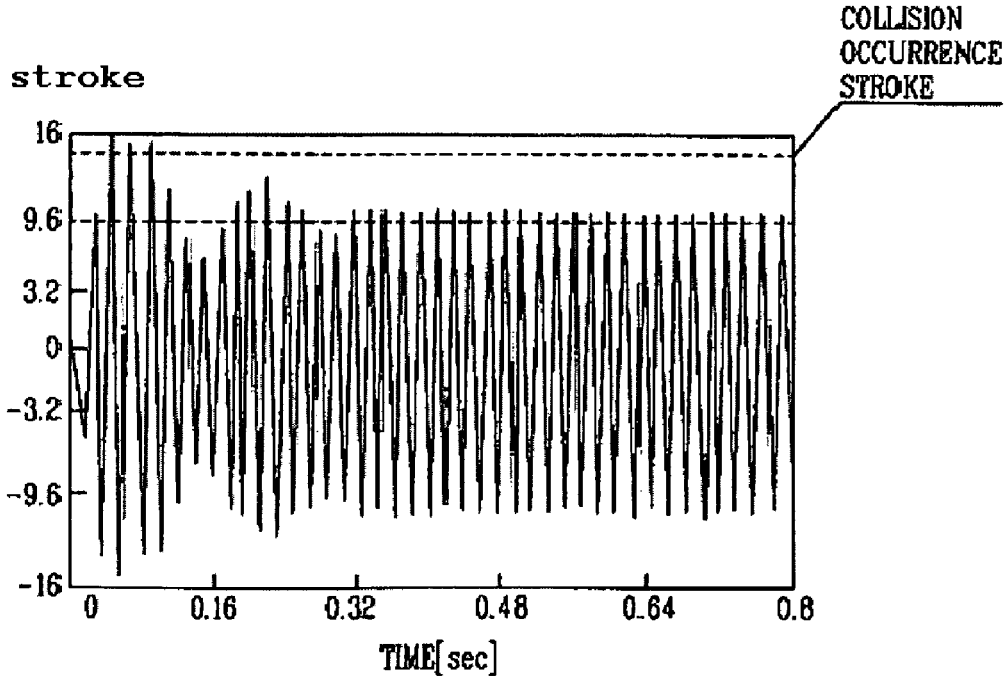
FIG. 2 CONVENTIONAL ART
FIG. 2 is a wave diagram illustrating a piston stroke of the reciprocating compressor in FIG. 1.
Figure 3:
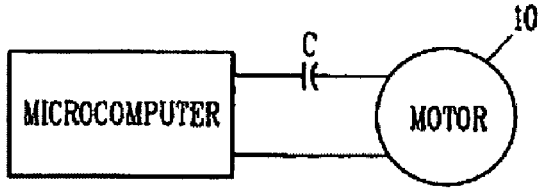
FIG. 3 CONVENTIONAL ART
FIG. 3 illustrates another example of a driving apparatus of a reciprocating compressor in accordance with the conventional art.
Figure 4:
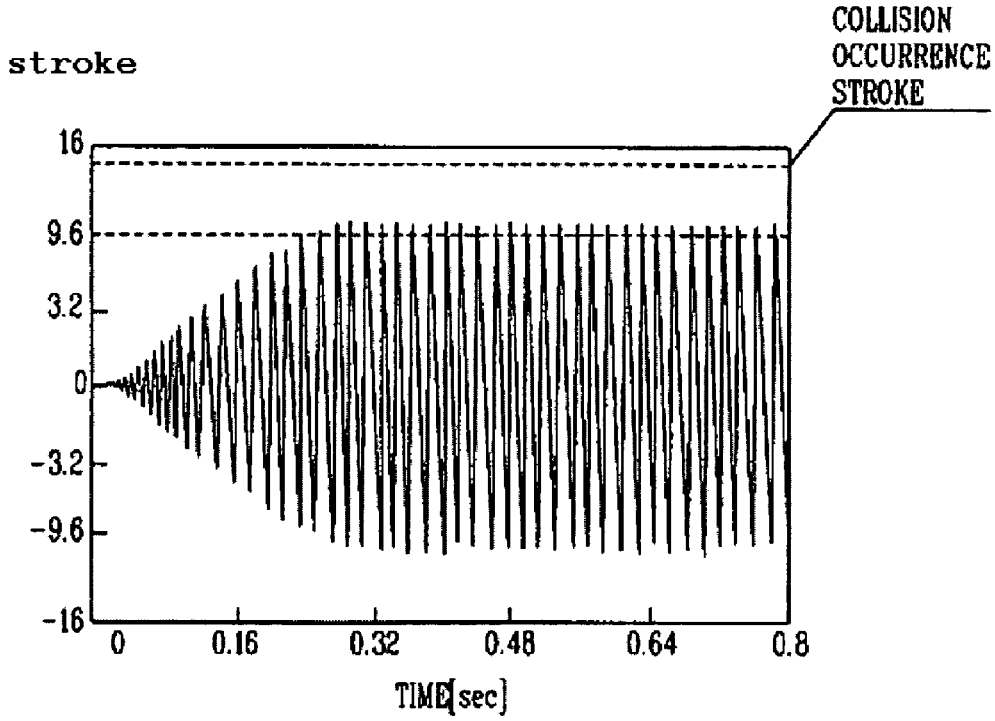
FIG. 4 CONVENTIONAL ART
FIG. 4 is a wave diagram illustrating a piston stroke of the reciprocating compressor in FIG. 3.
Figure 5:
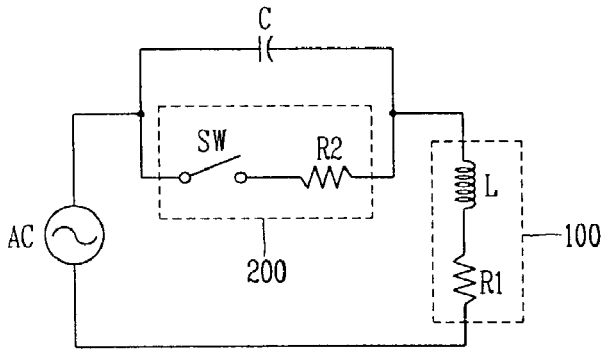
FIG. 5 is a circuit diagram illustrating a driving apparatus of a reciprocating compressor in accordance with a first embodiment of the present invention.

Referring to the drawings wherein like numerals represent like elements, FIG. 5 is a circuit diagram illustrating a driving apparatus of a reciprocating compressor in accordance with a first embodiment of the present invention.

As depicted in FIG. 5, the driving apparatus of the reciprocating compressor in accordance with the first embodiment of the present invention includes a PTC (positive temperature coefficient) device 200 for adjusting an initial power voltage supplied from a power supply unit (AC; alternating current) as a certain, or predetermined, value in an initial operation of a motor 100, outputting the adjusted power voltage to the motor 100 and cutting off the power voltage supplied from the power supply unit after a certain, or predetermined, time (for example, approximately 0.5 second) has passed; and a capacitor C for applying the power voltage supplied from the power supply unit to the motor 100. In more detail, in the initial operation of the reciprocating compressor (motor of the compressor), the power voltage is supplied to the motor 100 through the PTC device 200 for a certain time (for example, approximately 0~0.5 second), after a certain time has passed (for example, 0.5 second ~∞ seconds), the power voltage is supplied to the motor 100 through the capacitor C.

In addition, the PTC device 200 includes an equivalent circuit including a switch SW parallel-connected to the capacitor C and a resistor R2 serial-connected to the switch SW. In addition, reactance L and a resistor R1 construct an equivalent circuit of the motor 100. Herein, the PTC device 200 is for performing on/off operations according to an inner temperature, when an inner temperature is lower than a reference temperature, current/voltage are passed, when an inner temperature is higher than the reference temperature, current/voltage are cut off. In more detail, in the initial operation of the motor 100, because a resistance value R2 of the PTC device 200 is less than an impedance value of the capacitor C, current flows to the motor 100 through the PTC device 200 for a certain time (for example, approximately 0 second~0.5 second). Herein, in the initial operation of the motor 100, an initial temperature of the PTC device 200 is lower than the reference temperature. On the contrary, after a certain time has passed (for example, after approximately 0.5 second), an inner temperature rises, a resistance value is infinite due to the inner temperature, and accordingly current applied to the motor 100 is cut off by the infinite resistance value. In more detail, the PTC device 200 performs a switch function for cutting off or passing current according to a certain time (inner temperature).

In the mean time, instead of the PTC device 200, it is understood by those skilled in the art to use various power voltage control units having the same function with the PTC device 200 in the present invention.

Hereinafter, the operation of the driving apparatus of the motor 100 for the reciprocating compressor in accordance with the first embodiment of the present invention will be described with reference to accompanying FIGS. 6A and 6B.

Figure 6A:
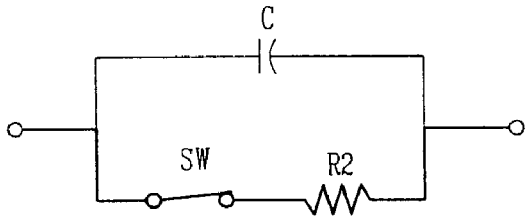
FIG. 6A illustrates a power application through a PTC (positive temperature coefficient) device.

FIG. 6A illustrates a power application through a PTC device 200, as shown in bold lines. In more detail, it shows a state in which the current flows to the motor 100 through the PTC device 200. As depicted in FIG. 6A, the PTC device 200 is turned on in the initial operation of the motor 100 of the reciprocating compressor, and the power voltage is supplied to the motor 100 through the PTC device 200. Herein, according to the resistance value R2 of the PTC device 200, the resistance value R1 of the motor 100 and the inductor value L, impedance of the motor 100 is increased, the operation current for varying a piston stroke is reduced so as to be not greater than a certain value, and accordingly, a stable piston stroke can be maintained. Herein, the certain value is a current value maintainable for a stroke in which the piston does not collide against other construction parts installed at the top or bottom portion of the cylinder of the reciprocating compressor.

Figure 7:
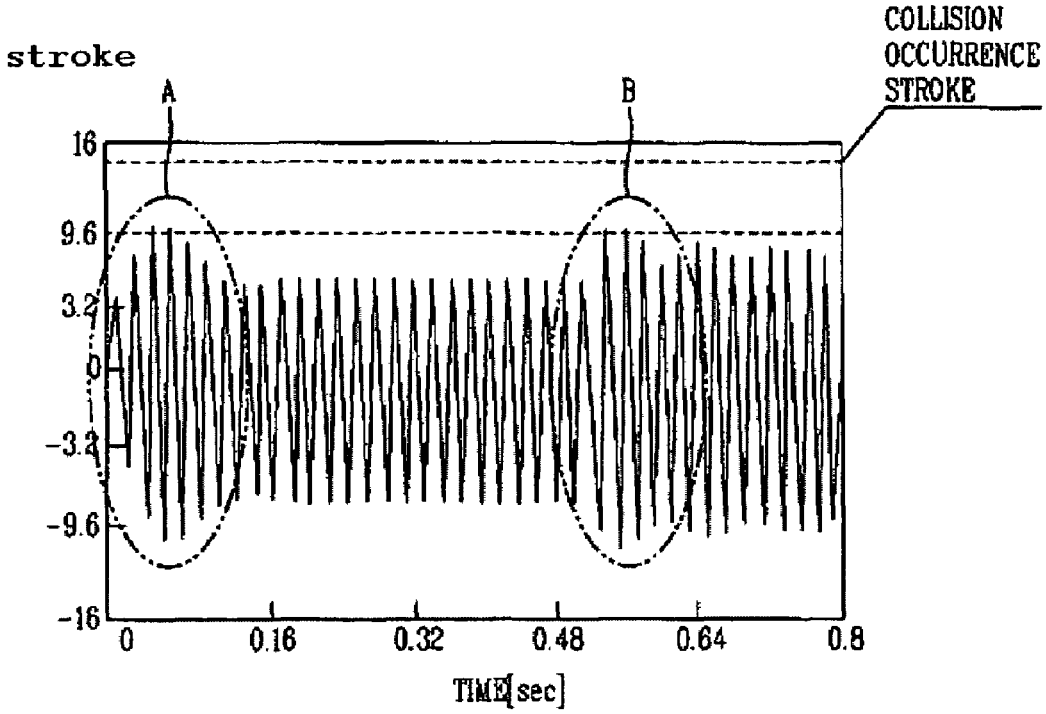
FIG. 7 is a wave diagram illustrating a piston stroke of the reciprocating compressor in FIG. 5.

FIG. 7 is a wave diagram illustrating a piston stroke of the reciprocating compressor in FIG. 5. As depicted in FIG. 7, according to the resistance value R2 of the PTC device 200, the resistance value R1 of the motor 100 and the inductor value L, impedance of the motor 100 is increased, the operation current for varying a piston stroke is reduced so as to be not greater than a certain value, and accordingly it is possible to maintain a stable piston stroke shown as an "A" region in FIG. 7.

In the meantime, when the inner temperature rises after a certain time has passed, the PTC device 200 is turned off. In more detail, when current flows to the motor 100 through the PTC device 200 for a certain time (for example, approximately 0~0.5 second) and a certain time has passed (for example, approximately 0.5 second ~8), an inner temperature of the PTC device 200 rises, and accordingly the PTC device 200 is turned off. Herein, after the certain time, current flows to the motor 100 through the capacitor C. Accordingly, when a piston stroke reaches a certain value, the PTC device 200 is turned off.

Figure 6B:
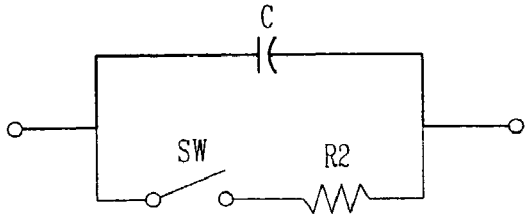
FIG. 6B illustrates a power application through a capacitor.

FIG. 6B illustrates a power apply through a capacitor. As depicted in FIG. 6B, the initial power voltage is supplied to the motor 100 through the PTC device 200, and the piston stroke is maintained stably. Afterward, the PTC device 200 is turned off, and the power voltage is supplied to the motor 100 through the capacitor C, as shown in bold lines. Herein, although the impedance of the motor 100 is reduced as much as the capacitive reactance of the capacitor C, because the counter electromotive force exists in the motor 100, power voltage reduced as the counter electromotive force is supplied to the motor 100. Accordingly, because power voltage reduced as the counter electromotive force is supplied to the motor 100, operational current for varying a piston stroke is reduced, and accordingly, the reciprocating compressor maintains a stable stroke shown as a "B" region in FIG. 7. In more detail, the motor 100 of the reciprocating compressor can be stably operated.

Figure 8:
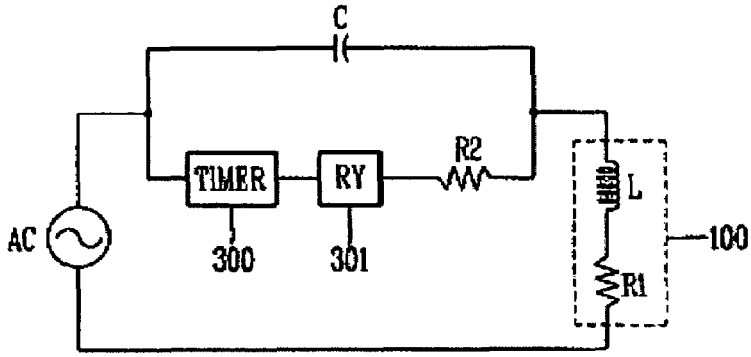
FIG. 8 is a circuit diagram illustrating a driving apparatus of a reciprocating compressor in accordance with a second embodiment of the present invention.

FIG. 8 is a circuit diagram illustrating a driving apparatus of a reciprocating compressor in accordance with the second embodiment of the present invention.

As depicted in FIG. 8, the driving apparatus of the reciprocating compressor in accordance with a second embodiment of the present invention includes a timer 300 for counting a time when the initial power voltage is supplied to the motor 100, generating a control signal when the counting time reaches a preset time and outputting the generated control signal; a relay 301 serial-connected to the timer 300, outputting the power voltage supplied from the power supply unit as it is in the initial operation of the motor 100 or cutting off the power voltage on the basis of the control signal; a resistor R2 serial-connected to the relay 301, maintaining the power voltage outputted from the relay 301 as a certain value and applying the certain power voltage to the motor 100; and a capacitor C electrically parallel-connected to the timer 300 and applying power voltage from the power supply unit to the motor 100 when the power voltage is cut off by the relay 301.

Hereinafter, the operation of the driving apparatus of the reciprocating compressor in accordance with the second embodiment of the present invention will be described in detail.

First, the relay 301 is tuned on in the initial operation of the motor 100 of the reciprocating compressor and applies the power voltage supplied from the power supply unit AC to the motor 100 through the resistor R2. Herein, according to a resistance value of the resistor R2, a resistance value R1 of the motor 100 and an inductor value L, impedance in the motor 100 is increased, and operational current for varying a piston stroke is reduced so as to be not greater than a certain value. And, accordingly it is possible to maintain a stable piston stroke shown as the "A" region in FIG. 7. Herein, the certain value is a current value maintainable a stroke in which the piston does not collide against other construction parts installed at the top or bottom portion of the cylinder of the reciprocating compressor.

After a preset time has passed, the timer 300 generates a control signal and outputs the generated control signal to the relay 301.

The relay 301 receives the control signal outputted from the timer 300 and cuts off the power voltage supplied from the power supply unit on the basis of the received control signal. Herein, when the relay 301 cuts off the power voltage supplied from the power supply unit, the capacitor C applies the power voltage supplied from the power supply unit to the motor 100. Herein, although the impedance in the motor 100 is reduced as much as the capacitive reactance of the capacitor C, because the counter electromotive force exists in the motor 100, power voltage reduced as the counter electromotive force is supplied to the motor 100. Accordingly, because power voltage reduced as the counter electromotive force is supplied to the motor 100, operational current for varying a piston stroke is reduced, and accordingly the reciprocating compressor maintains a stable stroke shown as the "B" region in FIG. 7.

As described above, in the present invention, by supplying a power voltage to the motor not through a capacitor, but through a PTC or a relay and a resistor in an initial operation of the reciprocating compressor and supplying a power voltage to the motor only through the capacitor after a certain time has passed, it is possible to control the motor stably in the initial state. In more detail, in the initial operation of the reciprocating compressor, when a counter electromotive force does not exist, because impedance is reduced according to the capacitor and inductance in the motor, it is possible to prevent an excessive piston stroke.

In addition, in the present invention, without using expensive equipment such as a microcomputer, etc., by using a simple, inexpensive apparatus such as a PTC or a relay and a resistor, excessive piston stroke in an initial operation of a motor of a reciprocating compressor can be prevented, and accordingly a production cost of the reciprocating compressor can be reduced.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A driving apparatus of a motor, comprising:

a capacitor, one connector of the capacitor being connected to a motor and the other connector of the capacitor being connected to an AC power supply; and a positive temperature coefficient (PTC) device simultaneously connected in parallel with said capacitor and connected in series with the AC power supply and the motor, wherein said capacitor is configured to apply a power voltage supplied from the power supply to the motor when said PTC device cuts off the power voltage, and said PTC device is configured to adjust an initial power voltage supplied from the AC power supply as a predetermined power voltage in an initial operation of the motor, maintain and output the predetermined power voltage, and cut off the power voltage after a predetermined time has passed.

2. A driving apparatus of a motor, comprising a capacitor, one connector of the capacitor being connected to a motor and the other connector of the capacitor being connected to an AC power supply; and a power voltage control simultaneously connected in parallel with said capacitor and connected in series with the AC power supply and the motor, wherein said capacitor is configured to apply a power voltage supplied from the AC power supply to the motor when said power voltage control cuts off the power voltage, and said power voltage control unit is configured to adjust an initial power voltage supplied from the AC power supply as a predetermined power voltage in an initial operation of the motor, maintain and output the predetermined power voltage, and cut off the power voltage after a predetermined time has passed, wherein said power voltage control unit comprises:

a timer configured to count a time when the power voltage is supplied to the motor in the initial state and output the control signal when the time reaches the predetermined time;

a switch configured to select between outputting the initial power voltage supplied from the power supply and cutting off the power voltage, based on the control signal; and a resistor configured to apply the power voltage outputted from the switch to the motor.

3. A driving apparatus of a reciprocating compressor, comprising:

a positive temperature coefficient (PTC) device configured to adjust an initial power voltage supplied from an AC power supply as a predetermined power voltage in an initial operation of a motor, maintain and output the predetermined power vo1tage, and cut off the power voltage after a predetermined time has passed; and a capacitor configured to apply the power voltage supplied from the power supply to the motor when said PTC device cuts off the power voltage, wherein power continues to be supplied to said capacitor when said PTC device cuts off the power voltage.

4. A driving apparatus of a reciprocating compressor, comprising:

a timer configured to:

apply a power voltage supplied from a an AC power supply in an initial operation of a motor of a reciprocating compressor; and count a time when the power voltage is supplied to the motor in the initial state and output the control signal when the time reaches the predetermined time;

a switch configured to select between outputting the power voltage applied from the timer and cutting off the control signal, based on the control signal;

a resistor configured to output the power voltage outputted from the switch as a predetermined value and apply the predetermined power voltage to the motor; and a capacitor configured to apply the power voltage supplied from the power supply to the motor when said switch cuts off the power voltage, wherein power continues to be supplied to said capacitor when said switch cuts off the power voltage.

5. A method for driving a motor, comprising:

applying a power voltage to the motor using a positive temperature coefficient (PTC) device after adjusting an initial power voltage supplied from the AC power supply as a predetermined power voltage in an initial operation of the motor, and maintaining the predetermined power voltage;

cutting off the power voltage after a predetermined time has passed; and applying the power voltage to the motor, using a capacitor, one connector of the capacitor being connected to the motor and the other connector of the capacitor being connected to a power supply when the power voltage is cut off by the PTC device simultaneously connected in parallel with said capacitor and connected in series with the AC power supply and the motor.

6. A method for driving a motor, comprising:

applying a power voltage to the motor using a power voltage control unit after adjusting an initial power voltage supplied from an AC power supply as a predetermined power voltage in an initial operation of the motor, and maintaining the predetermined power voltage;

cutting off the power voltage after a predetermined time has passed; and applying the power voltage to the motor, using a capacitor, one connector of the capacitor being connected to the motor and the other connector of the capacitor being connected to a power supply, when the power voltage is cut off by a power voltage control unit simultaneously connected in parallel with said capacitor and connected in series with the AC power supply and the motor;

generating a control signal after the predetermined time has passed;

outputting the control signal; selectively outputting the initial power voltage supplied from the AC power supply and cutting off the power voltage, based on the control signal; and applying the power voltage outputted from a switch to the motor.

7. The method of claim 6, further comprising:

counting a time when the power voltage is supplied to the motor in the initial state; and outputting the control signal when the time reaches the predetermined time.

8. A driving method of a reciprocating compressor, comprising:

supplying a power voltage to a positive temperature coefficient (PTC) device;

maintaining the power voltage at a predetermined level, using the positive temperature coefficient (PTC) device, when a motor is operated;

selectively outputting the predetermined power voltage and cutting off the power voltage after a predetermined time has passed;

applying the power voltage to the motor, using a capacitor, when the power voltage is cut off by the PTC device;

applying, using the PTC device, the power voltage to the motor in an initial state and cuffing off the power voltage after the predetermined time has passed; and continuing to supply power to the capacitor when the power voltage is cut off by the PTC device.

9. A driving method of a reciprocating compressor, comprising:

applying a power voltage supplied from an AC power supply in an initial operation of a motor of a reciprocating compressor;

counting a time when the power voltage is supplied to the motor in the initial state and outputting the control signal when the time reaches the predetermined time;

generating a control signal when a predetermined time has passed;

outputting the generated control signal;

selectively outputting the applied power voltage and cuffing off the control signal, based on the control signal;

maintaining the outputted power voltage as a predetermined value and applying the predetermined power voltage to the motor;

applying, via a capacitor, the power voltage supplied from the power supply to the motor when the power voltage is cut off; and continuing to supply power to the capacitor when the power voltage is cut off.

* * * * *

UNITED STATES PATENT AND TRADEMARK OFFICE

CERTIFICATE OF CORRECTION

PATENT NO. : 7,459,869 B2
APPLICATION NO. : 10/414231
DATED : December 2, 2008
INVENTOR(S) : K Park It is certified that error appears in the above-identified patent and that said Letters Patent is hereby corrected as shown below:

At Column 10, line 36 (Claim 9) “cuffing” should be -- cutting --.

Signed and Sealed this

Twenty-fourth Day of March, 2009

JOHN DOLL
*Acting Director of the United States Patent and Trademark Office*